US011672364B2

(12) United States Patent
Lewis

(10) Patent No.: US 11,672,364 B2
(45) Date of Patent: Jun. 13, 2023

(54) BREATHABLE COMFORTER

(71) Applicant: Aubrey Lewis, Bear, DE (US)

(72) Inventor: Aubrey Lewis, Bear, DE (US)

( * ) Notice: Subject to any disclaimer, the term of this patent is extended or adjusted under 35 U.S.C. 154(b) by 135 days.

(21) Appl. No.: 17/147,835

(22) Filed: Jan. 13, 2021

(65) Prior Publication Data

US 2021/0219751 A1 Jul. 22, 2021

Related U.S. Application Data

(60) Provisional application No. 62/963,684, filed on Jan. 21, 2020.

(51) Int. Cl.
*A47G 9/02* (2006.01)

(52) U.S. Cl.
CPC ..... *A47G 9/0223* (2013.01)

(58) Field of Classification Search
CPC ..... A47G 9/02223; A47G 9/0215; A47G 9/0207; A47G 9/02
See application file for complete search history.

(56) References Cited

U.S. PATENT DOCUMENTS 2,368,220 A * 1/1945 Hinds ..... A47G 9/086 5/413 R
3,325,832 A * 6/1967 Malicki ..... A47G 9/0238 5/495
3,696,450 A * 10/1972 Dupler ..... A47G 9/0207 5/486
3,717,888 A * 2/1973 Phelan ..... A47G 9/086 135/117
4,787,105 A * 11/1988 Phillips ..... A47G 9/086 5/413 R
6,557,192 B2 * 5/2003 Zheng ..... A47G 9/062 5/413 R
6,615,427 B1 * 9/2003 Hailey ..... D05C 17/00 5/482
7,107,638 B2 * 9/2006 Wilson ..... A47G 9/0207 5/923
7,849,534 B2 * 12/2010 Bellick ..... A47G 9/086 5/413 R
9,149,402 B2 * 10/2015 Gil Gomez ..... A61G 7/1063
9,247,826 B1 * 2/2016 Holbrook ..... A47G 9/0261
D785,371 S * 5/2017 Volpe, II ..... D6/602
2007/0169264 A1 * 7/2007 Spicer ..... A47G 9/0207 5/482

(Continued)

*Primary Examiner* — Eric J Kurilla
(74) *Attorney, Agent, or Firm* — Boudwin Intellectual Property; Daniel Boudwin

(57) ABSTRACT

A breathable comforter is provided. The breathable comforter includes a main body with at least one mesh body that runs along a width of the main body. The mesh bodies are integrated into the main body and enable an individual to breathe therethrough. A plurality of fasteners run along the width of the main body. A plurality of complementary fasteners is disposed on a minor body. The plurality of fasteners and the plurality of complementary fasteners couple together to selectively secure the minor body to the main body, in such a configuration where the minor body covers over the mesh body. In some embodiments, a plurality of pockets is disposed on the main body. The plurality of pockets is configured to house weighted inserts. The device can be used to enable an individual or a pet to sleep under a comforter while being able to breathe therethrough.

7 Claims, 2 Drawing Sheets

(56) References Cited

U.S. PATENT DOCUMENTS

| | | | | |
|---|---|---|---|---|
| 2013/0067660 | A1* | 3/2013 | Sloan | A47G 9/02 5/413 R |
| 2014/0189952 | A1* | 7/2014 | Crispino | A47G 9/02 112/475.08 |
| 2014/0352063 | A1* | 12/2014 | Mitchell | A47G 9/0207 5/494 |
| 2017/0295961 | A1* | 10/2017 | Alletto | A47G 9/0261 |
| 2018/0192794 | A1* | 7/2018 | Aramli | A47G 9/0215 |
| 2018/0249849 | A1* | 9/2018 | Wilkinson | A47G 9/062 |
| 2019/0239664 | A1* | 8/2019 | Hill | A47G 9/08 |
| 2021/0267390 | A1* | 9/2021 | Storm | A47G 9/0223 |

* cited by examiner

BREATHABLE COMFORTER

CROSS REFERENCE TO RELATED APPLICATIONS

This application claims the benefit of U.S. Provisional Application No. 62/963,684 filed on Jan. 21, 2020. The above identified patent application is herein incorporated by reference in its entirety to provide continuity of disclosure.

BACKGROUND OF THE INVENTION

The present invention relates to a bedding apparatus. More specifically, the present invention provides a comforter that has a mesh body that allows for ventilation underneath the comforter for when a user sleeps with the comforter over their head.

When people are sleeping, often they prefer their bodies to be warm. The function of a comforter is to trap the body heat that a person gives off while they sleep. When the body heat is trapped, their body can remain warm, even if the surrounding area of the room is cold. When the body is kept warm throughout the night, it allows people to have efficient sleeping cycles and be well rested. Beyond just staying warm at night, many people also choose to have their head covered by the comforter while they sleep.

Weighted blankets can help those with anxiety and other mental illnesses. For people who suffer from anxiety and other mental illnesses, they can also find comfort and be relaxed when they have their head underneath the comforter. When their head is underneath the comforter, they can limit the anguish and stress they experience from their anxiety or other mental illness.

Some of the issues that an individual can experience from having a comforter placed over their head while they sleep, includes an increase in carbon dioxide levels and a high risk of suffocation. During a night of sleep, humans continue to breathe at a consistent rate. When the head is under the comforter the carbon dioxide levels underneath the comforter rise with each exhale. When the levels of carbon dioxide rise, the oxygen level underneath the comforter lowers. With little access to oxygen, the person who is underneath the comforter has an increased risk of suffocation. This risk can be exacerbated if the person also has a respiratory disease or deficiency. As a result, when people do sleep with their head under the comforter, they often must continuously re-adjust their body throughout the night in order to breathe comfortably and receive appropriate amount of oxygen. This constant body movement can disturb their sleep.

Where current comforters can provide relief to those with anxiety and other mental illness, such as weighted blankets, there is not a current comforter that provides individuals with the ability to receive proper air ventilation when they have their head underneath a comforter while they sleep.

Therefore, there is a defined need amongst the known prior art references for a comforter that provides enhanced ventilation for a user that sleeps with the comforter over their head.

SUMMARY OF THE INVENTION

In view of the foregoing disadvantages inherent in the known types of comforters now present in the known art, the present invention provides a new breathable comforter wherein a portion of the comforter can disengaged from a main body of the comforter to reveal a mesh body that will allow users to breathe during their sleep when the comforter is over their head.

It is therefore an object of the present invention to provide a breathable comforter that allows the user to breathe when the comforter is covering their whole head. A plurality of fasteners secures a minor body of the comforter to the main body of the comforter. When a user wants to pull the comforter over their head, the plurality of fasteners can be unfastened. Unfastening the plurality of fasteners detaches the minor body of the comforter from the main body of the comforter. When the minor body of the comforter is detached from the main body of the comforter a mesh body is exposed. With the mesh body exposed, a user will be able to have ventilation underneath the comforter so they can breathe during their sleep when the comforter is over their head. The mesh body will also permit the user to sleep without having to constantly move their head above the comforter to breathe.

Another aspect of the present invention is the plurality of pockets. The plurality of pockets disposed on the main body of the comforter allow for the user to add weighted inserts into the pocket to weigh the comforter down. When the weighted inserts are placed within the plurality of pockets, the user can secure the comforter in the same position so that when they are sleeping, the comforter will not fall off the user's body. Additionally, the weighted inserts allow the breathable comforter to have therapeutic effects for individuals who suffer from mental health issues that experience anxiety and panic attacks.

Yet another aspect of the present invention is to allow multiple users to use the comforter. When multiple users sleep in the same bed, they each can have different sleeping preferences. For example, one person might prefer to sleep with their head under the comforter and the other person might prefer to not sleep with their head under the comforter. In this instance, both users can sleep according to their preferences without bothering the other user.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
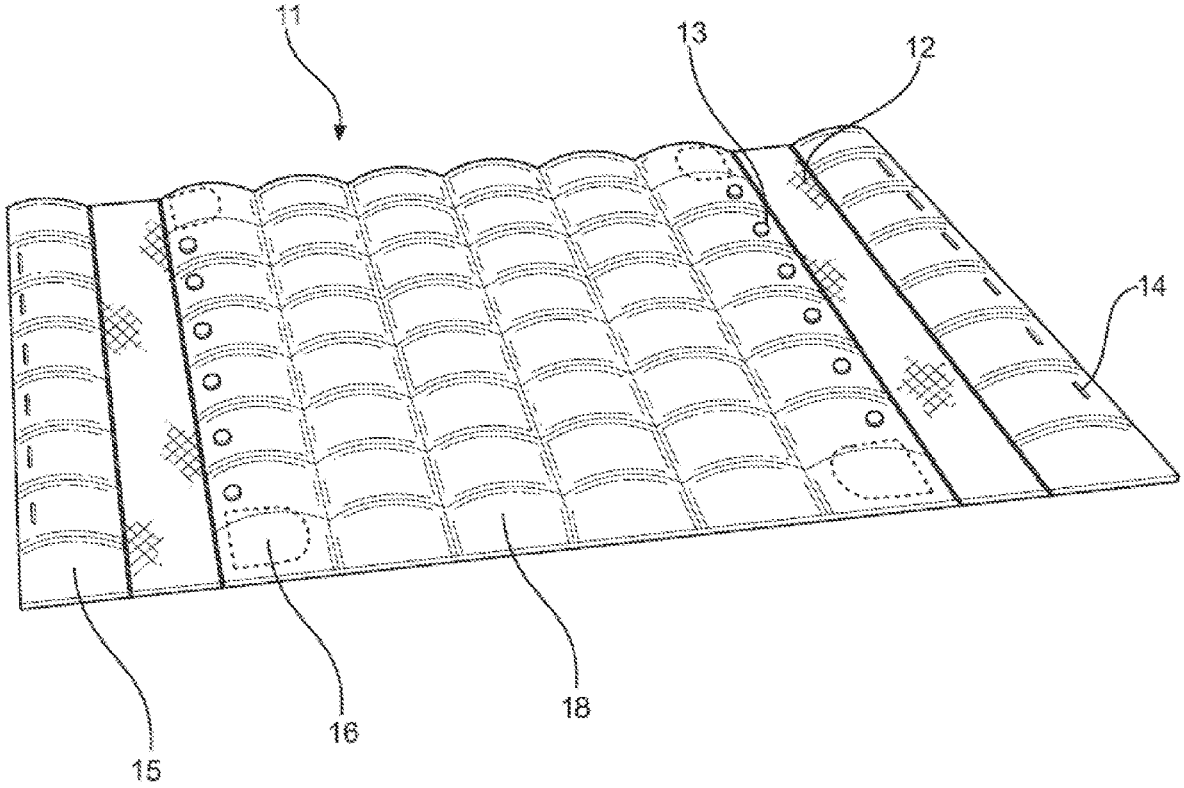
FIG. 1 shows a perspective view of an embodiment of the breathable comforter.

Reference is made herein to the attached drawings. Like reference numerals are used throughout the drawings to depict like or similar elements of the breathable comforter. For the purposes of presenting a brief and clear description of the present invention, the preferred embodiment will be discussed is the comforter with two mesh bodies for ventilation on opposing sides of the comforter. The figures are intended for representative purposes only and should not be limiting in any respect.

FIG. 1 shows a perspective view of an embodiment of the breathable comforter. The breathable comforter 11 comprises a main body 18, at least one minor body 15, and at least one mesh body 12. The main body 18 further comprises a top face, a bottom face, a front edge, a rear edge, and a pair of side edges. A plurality of fasteners 13 are disposed along the top face of the main body 18 extending from one side edge to the other side edge. The plurality of fasteners 13 are approximate to the front edge and rear edge of the main body 18. Additionally, a plurality of pockets 16 is disposed on the top face of the main body 18. The plurality of pockets 16 each include an access point to the pocket. The access point may be opened and sealed for a user to place a weighted insert inside the plurality of pockets 16. The weighted inserts can be used to keep the user's body in position and additional weight insert can be added to reach a desired weight to the breathable comforter 11 for the individual laying thereunder.

The mesh body 12 is affixed to the main body 18. The mesh body 12 further comprises a top face, a bottom face, a front edge, a rear edge, and a pair of side edges. In an embodiment of the breathable comforter 11 where there is one mesh body 12, the rear edge of the mesh body 12 is affixed to the front edge of the main body 18. In another embodiment of the breathable comforter 11 where there is more than one mesh body 12, the rear edge of the first mesh body 12 is affixed to the front edge of the main body 18 and the front edge of the second mesh body 12 is affixed to the rear edge of the main body 18.

The minor body 15 is affixed to the mesh body 12. The minor body 15 further comprises a top face, a bottom face, a front edge, a rear edge, and a pair of side edges. In an embodiment of the breathable comforter 11 where there is one mesh body 12, the rear edge of the minor body 15 is affixed to the front edge of the mesh body 13. In another embodiment of the breathable comforter 11 where there is more than one mesh body 12, there is more than one corresponding minor body 15. In such an embodiment of the breathable comforter 11, the front edge of the first mesh body 12 is affixed to the rear edge of the first corresponding minor body 15 and the rear edge of the second mesh body 12 is affixed to the front edge of the second corresponding minor body 15.

Each of the fasteners 13 disposed on the top face of the main body 18 has a plurality of complementary fasteners 14 disposed on the top face of the minor body 15. In one embodiment of the breathable comforter 11, the plurality of fasteners 13 are buttons and the plurality of complementary fasteners 14 are button slits. In another embodiment of the breathable comforter 11, the plurality of fasteners 13 are snap connectors and the plurality of complementary fasteners 14 are the corresponding snap receptors.

Figure 2:
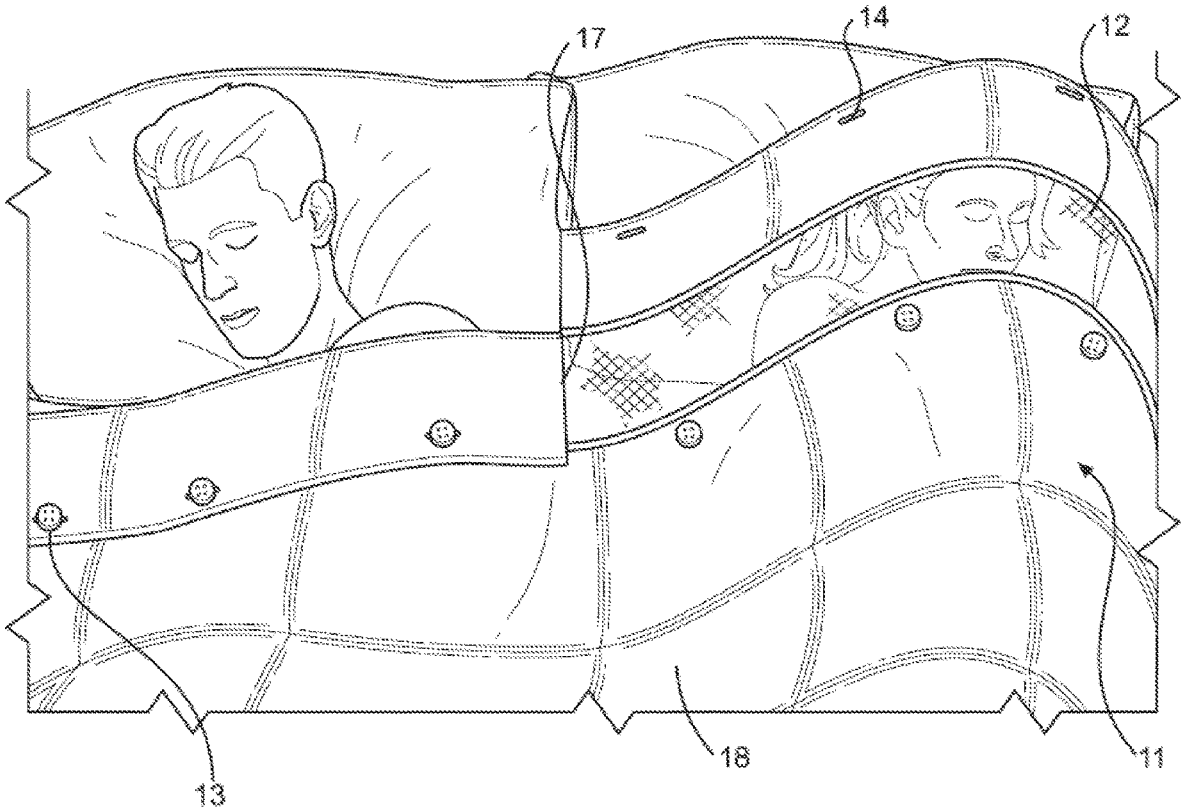
FIG. 2 shows a perspective view of an embodiment of the breathable comforter in use.

FIG. 2 shows a perspective view of an embodiment of the breathable comforter in use. In use, the breathable comforter 11 will be placed above the user while they are sleeping. If the user wants to have the mesh body 12 to be exposed, the user will disengage the minor body 15 from the main body 18 by detaching the plurality of fasteners 13 from the plurality of complementary fasteners 14. When the mesh body 12 is exposed, a user will be able to place the breathable comforter 11 over their head while they sleep. The mesh body 12 will align with user's nose and face thereby enabling the individual to breathe therethrough while the breathable comforter 11 is over their head.

If the user does not want to have the mesh body 12 exposed, the user will engage the minor body 15 with the main body 18 by attaching the plurality of fasteners 13 to the plurality of complementary fasteners 14. When the minor body 15 is coupled to the main body 18 by the plurality of fasteners 13, the mesh body 12 is covered by the minor body 15.

The minor body 15 is divided into at least two equal portions 17 for when the breathable comforter 11 is being used by more than one user. When there is more than one user of the same breathable comforter 11, one user can have their corresponding portion of the minor body 15 remained secured to the main body 18 and the other user can have their corresponding portion of the minor body 15 disengaged from the minor body 18 for the mesh body 12 to be exposed.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A comforter, comprising:

a main body having a top face, a bottom face, a front edge, a rear edge, and a pair of side edges;

a plurality of pockets dispose don the top face of the main body;

at least one mesh body having a top face, a bottom face, a front edge, a rear edge, and a pair of side edges;

wherein a length of the front edge and a length of the rear edge of the main body are both equal to a length of the rear edge and a length of the front edge of the mesh body;

at least one minor body having a top face, a bottom face, a front edge, a rear edge, and a pair of side edges;

wherein the length of the front edge and the length of the rear edge of the mesh body is equal to a length of the rear edge and a length of the front edge of the minor body;

wherein the rear edge of a first minor body is coupled to the front edge of a first mesh body and the rear edge of the first mesh body is joined to the front edge of the main body;

wherein the front edge of a second minor body is coupled to the rear edge of a second mesh body and the front edge of the second mesh body is joined to the rear edge of the main body;

a plurality of fasteners is disposed on the top face of the main body.

2. The comforter of claim 1, wherein the plurality of fasteners on the main body are configured to selectively couple to a plurality of complementary fasteners disposed on the top side of the at least one minor body.

3. The comforter of claim 1, wherein the plurality of fasteners on the main body are removably coupled with the plurality of complementary fasteners on the at least one minor body to secure the at least one minor body to the main body, whereby the at least one minor body covers the entire top face of the corresponding at least one mesh body.

4. The comforter of claim 1, wherein the at least one minor body is divided into at least two equal portions.

5. The comforter of claim 4, wherein the at least two equal portions of the at least one minor body can be selectively secured to the main body.

6. The comforter of claim 1, wherein the plurality of pockets each include an access point to the pocket, wherein the access point may be opened and sealed.

7. The comforter of claim 1, wherein the plurality of pockets is adapted to house a weighted insert.

* * * * *